US006953092B2

(12) United States Patent
De Medeiros, Jr.

(10) Patent No.: US 6,953,092 B2
(45) Date of Patent: Oct. 11, 2005

(54) APPARATUS AND METHOD FOR FREE-FALL INSTALLATION OF AN UNDERWATER WELLHEAD

(75) Inventor: Cipriano José De Medeiros, Jr., Rio de Janeiro (BR)

(73) Assignee: Petroleo Brasileiro S.A. - PETROBRAS (BR)

( * ) Notice: Subject to any disclaimer, the term of this patent is extended or adjusted under 35 U.S.C. 154(b) by 131 days.

(21) Appl. No.: 10/329,782

(22) Filed: Dec. 27, 2002

(65) Prior Publication Data

US 2003/0121668 A1 Jul. 3, 2003

(30) Foreign Application Priority Data

Dec. 28, 2001 (BR) ..... 0106461

(51) Int. Cl.[7] ..... E21B 43/01; E21B 29/12
(52) U.S. Cl. ..... 166/368; 175/22; 114/295
(58) Field of Search ..... 166/368; 175/22; 114/311, 295

(56) References Cited

U.S. PATENT DOCUMENTS 70,844 A * 11/1867 Holdridge ..... 175/22
73,414 A * 1/1868 Welch et al. ..... 175/22
2,636,355 A * 4/1953 Thornley ..... 175/22
3,032,000 A * 5/1962 Feiler ..... 114/295
3,291,092 A * 12/1966 Halberg et al. ..... 114/295
3,831,386 A * 8/1974 Phares et al. ..... 405/249
3,910,218 A * 10/1975 Taylor et al. ..... 114/295
4,106,298 A * 8/1978 Mathieu et al. ..... 405/243
4,625,806 A * 12/1986 Silcox ..... 166/358
4,665,791 A * 5/1987 Bugiel ..... 175/20
4,877,353 A * 10/1989 Wisotsky, Sr. ..... 405/231
6,106,199 A * 8/2000 Medeiros et al. ..... 114/295

* cited by examiner

*Primary Examiner*—Jong-Suk (James) Lee
(74) *Attorney, Agent, or Firm*—Nixon & Vanderhye PC

(57) ABSTRACT

An apparatus and method for pre-installation of a petroleum wellhead on the seabed. The apparatus includes two principal components: a wellhead (1) and a ballast tube (9). The wellhead includes a tube in which are fixed guide fins (3) and structural fins (8). The ballast tube (9) includes a tube with a holding member (12) for its recovery after the wellhead (1) has been fixed on the seabed. The ballast tube (9) is placed inside the wellhead (1) and the assembly is launched towards the seabed, being embedded in it by the inherent weight of the assembly. After the wellhead (1) has been fixed, the ballast tube (9) is raised to the surface.

22 Claims, 6 Drawing Sheets

APPARATUS AND METHOD FOR FREE-FALL INSTALLATION OF AN UNDERWATER WELLHEAD

FIELD OF THE INVENTION

The present invention relates to an apparatus and a method for installing an underwater petroleum wellhead in the seabed.

DESCRIPTION OF RELATED ART

With the discovery of petroleum-producing fields in ever greater depths of water, the use of crafts for installing production installations has been growing increasingly expensive. Therefore, at all stages of exploration for petroleum and derivatives, particularly under the abovementioned conditions, the increased time required to carry out a specific task involves a considerable increase in the total production cost.

The initial stage of drilling an oil well consists of the installation, in the seabed, of a structure known as a wellhead. This structure basically consists of a tube that is embedded in the seabed in order to facilitate drilling of the well and the installation of equipment and components as the well is being drilled.

There are essentially two methods known in the prior art for fixing the wellhead to the seabed. The first uses pile drivers that are fitted into the tube to be fixed on the seabed. The tube is then embedded in the seabed, followed by installation of the remaining equipment and components.

The second method, used predominantly in well exploration in Brazil, consists in using the actual drilling equipment to install the wellhead. There is a choice of two techniques that can be used in this method. In the first of these, the sea floor is blasted with water and, simultaneously, the tube is pushed in to the desired depth. In the second technique, the floor is drilled to a specific depth and a tube is subsequently cemented into this drilled section.

Both techniques have their drawbacks. The method that involves blasting, in addition to being fairly hard work, often erodes the sea floor, which reduces the tube's holding and may even cause it to sink, with the consequent loss of the equipment. The method with drilling and cementing involves operational risks and high costs.

In both methods for installing the wellhead there is an excessive wastage of time, involving the drill craft or another specialized craft that could be employed in other activities, such as actual drilling of the well. Further, it is required to transport heavy and specialised equipment to the sea bed, perform the wellhead installing operation, and then transport the installing equipment back to the surface. This requires energy and takes time.

It has also been found to be difficult to structurally reinforce the wellhead before it is fixed to the seabed. In some cases, it has not been viable to reinforce the wellhead at all prior to installation.

It can therefore be seen that it would be extremely beneficial to devise a method of installing a wellhead which did not expend time and energy in transporting heavy and specialised equipment to the seabed, performing a wellhead installing operation and then transporting the equipment back to the surface. Furthermore, it would be beneficial to provide a method in which the wellhead can be structurally reinforced before it is fixed to the seabed, since such reinforcing is easier to carry out at the surface than when the wellhead is installed. As a general desire, it can be said that any method that allows activities at the seabed to be kept to a minimum will save time and energy due to the inherent difficulties in working at or near the seabed.

SUMMARY OF THE INVENTION

The present invention addresses the above-mentioned problems and provides an apparatus for installing a wellhead in the seabed which can be launched in a free fall so that the potential energy of the wellhead at or near the surface is converted into kinetic energy by the free fall, which kinetic energy serves to bury the wellhead in the seabed. It can therefore be seen that there is no requirement to transport heavy and specialised equipment to the seabed and back again and there is no requirement to perform difficult or complicated drilling and/or blasting operations at the seabed in order to install the wellhead. The wellhead is transported to, and installed into, the seabed using nothing but the potential energy that the apparatus possesses at the surface.

Installation of the wellhead is thus carried out more rapidly and without the need for a specialized craft since it is necessary only to launch the apparatus towards the seabed.

Furthermore, the present invention allows the wellhead to be structurally reinforced so that, when it is imbedded in the seabed, it will have a greater load capacity.

The invention provides an apparatus for free-fall installation of an underwater wellhead, said apparatus comprising a wellhead constructed and arranged to be embedded in the seabed following its free-fall.

In another aspect, the present invention provides a method of installing an underwater wellhead, said method comprising:

launching an assembly comprising said wellhead towards the seabed so that said assembly falls under its own weight and embeds itself in the seabed.

The embodiment of the apparatus that is the subject of the present invention basically comprises two principal components: a wellhead and a ballast tube. The wellhead, which will be fixed to the seabed, comprises a tube in which there are fixed guide fins and structural fins. These guide fins can be connected to vertical plates. The ballast tube, with a high specific gravity, comprises a tube with a connection member at its top enabling it to be recovered after installation of the wellhead.

The ballast tube is placed inside the wellhead and the whole assembly is launched (dropped) towards the seabed in a free fall, where it is embedded as a result of the inherent weight of the assembly. After this fixing operation, the ballast tube is pulled to the surface and the wellhead remains fixed to the seabed.

BRIEF DESCRIPTION OF THE DRAWINGS

The invention will now be described, by way of example only, by reference to the accompanying drawings, in which.

DETAILED DESCRIPTION OF A PREFERRED EMBODIMENT

Figure 1:
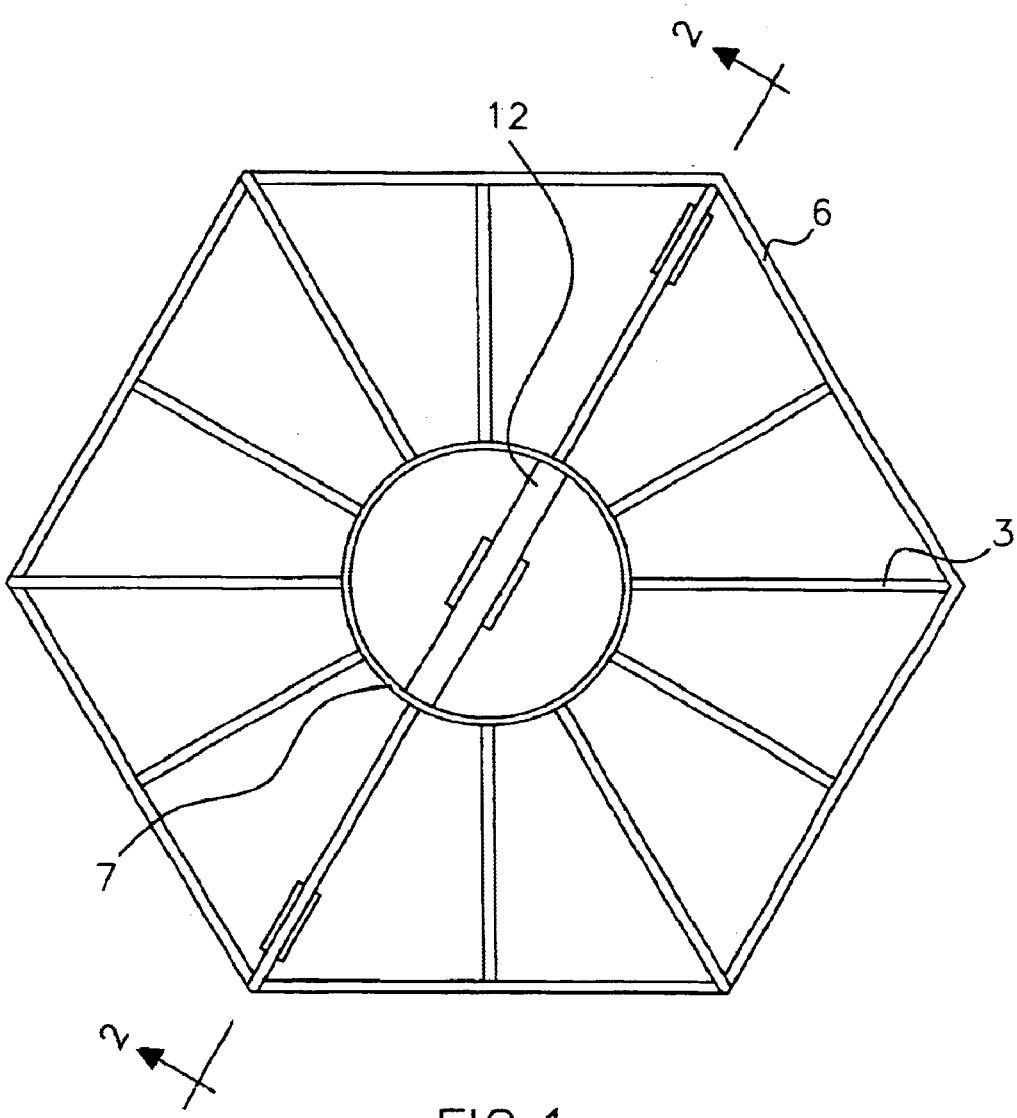
FIG. 1 is a top view of a first embodiment of an apparatus for free-fall installation of a wellhead that is the subject of the invention.
Figure 2:
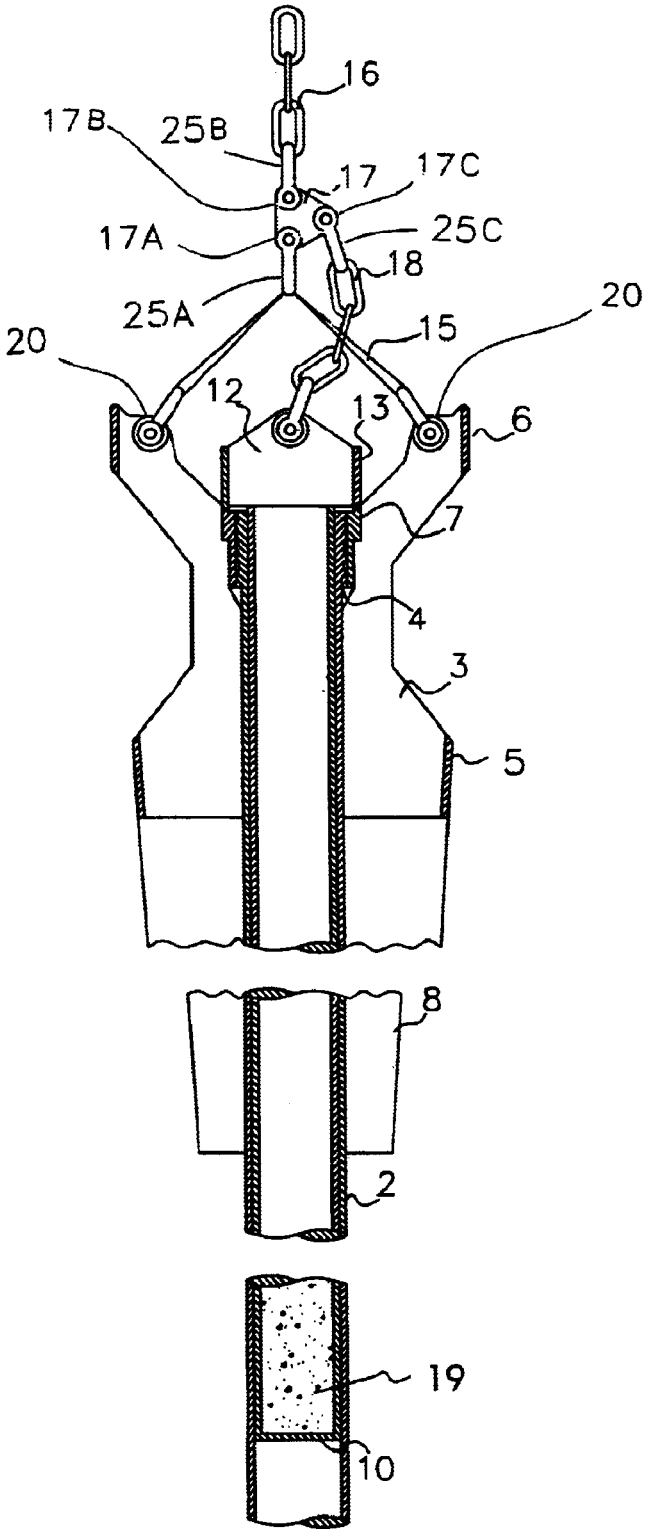
FIG. 2 is a cross-sectional view of a first embodiment of the apparatus, along cross-section line 2—2 in FIG. 1, with certain sections shown missing to assist explanation.
Figure 3:
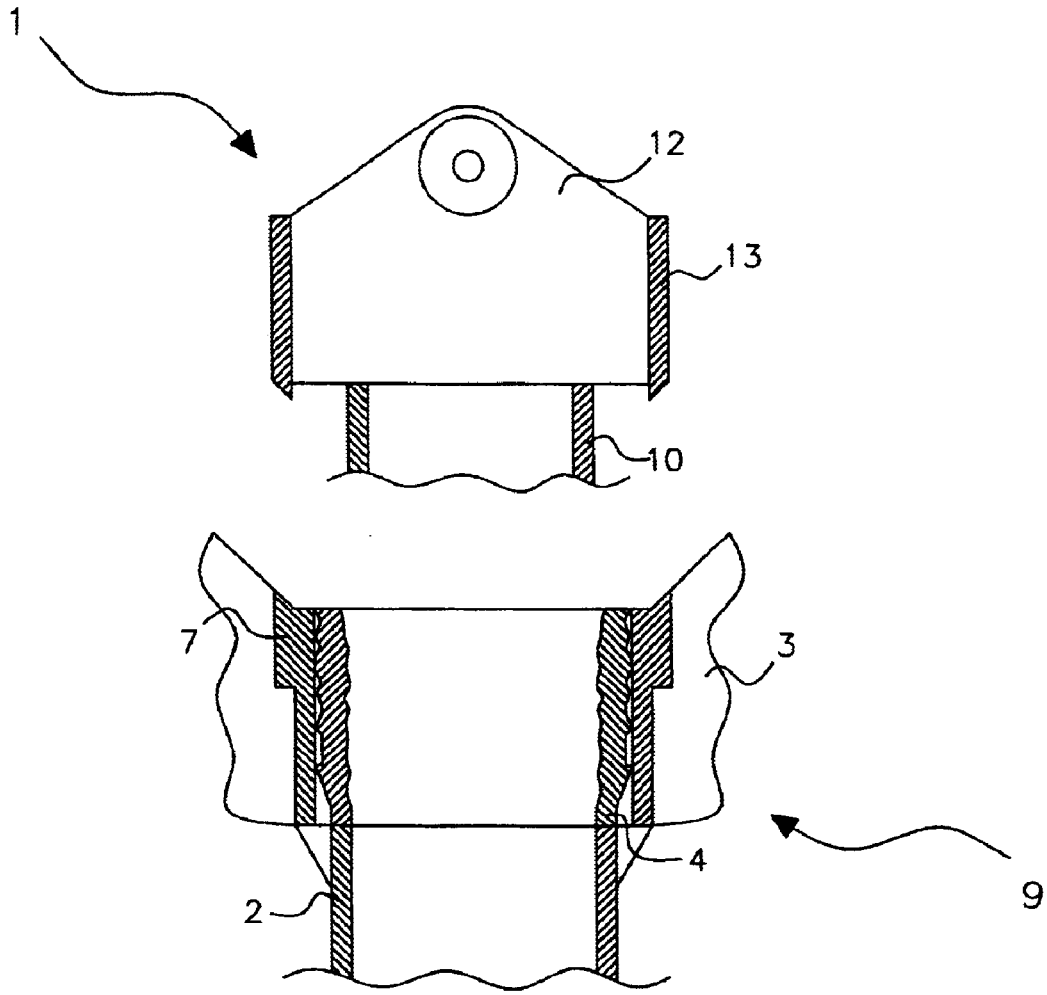
FIG. 3 is a detail of the region of contact between the two principal parts of the first embodiment of the apparatus.

FIGS. 1, 2 and 3 show a first embodiment of the apparatus for free-fall installation of an underwater wellhead that basically comprises two parts—a wellhead (1) and a ballast part (9)—as may be better seen in FIG. 3. The wellhead (1) comprises a carrier tube (2), which is the principal element to be fixed to the seabed, a plurality of vertically extending guide fins (3) rigidly fixed to the upper portion of the carrier tube (2), a holding member (7) rigidly fixed to upper portion (4) of the carrier tube (2), and a plurality of vertically extending structural fins (8) rigidly fixed to the lower portion of the carrier tube (2).

The purpose of the guide fins (3) is to guide the travel of the wellhead (1) when it is embedded in the seabed, and, after its fixing, they serve to facilitate the installation of equipment and components that are necessary during drilling of the oil well.

The guide fins (3) are provided, in their upper part, with upper vertical plates (6) and, in their lower part, with lower vertical plates (5). The purpose of the upper vertical plates (6) and lower vertical plates (5) is to confer strength on the structure formed by the guide fins (3) and to help brake the assembly formed by the wellhead (1) and by the ballast tube (9) when said assembly penetrates the sea floor.

The purpose of the holding member (7) fixed to the upper part of the carrier tube (2) is to support thereon the ballast part (9). The purpose of the structural fins (8) rigidly fixed to the lower part of the carrier tube (2) is to increase the axial and lateral load capacity of the wellhead (1). The structural fins give the wellhead the required strength to be able to successfully penetrate the seabed without being breached or buckling. Other strengthening means may be used, however. The guide fins (3) and structural fins (8) may be continuations of one another along the length of the carrier tube (2).

The ballast part (9) comprises a tube (10), extending below the wellhead (1), the length of which is designed such that the centre of gravity of the assembly formed by the wellhead (1) and the ballast part (9) together is located in a part that is as close as possible to the lower end of the assembly, so as to guarantee that, when the assembly is launched (dropped) towards the seabed, this lower end of the ballast part (9) is the first part of the assembly to touch the seabed.

A connection member (12) and a support member (13) are fixed to the upper part of the tube (10). The purpose of the connection member (12) is to allow withdrawal of the ballast part (9) after the wellhead (1) has been fixed, and the purpose of the support member (13) is to support the ballast part (9) on the holding member (7) of the wellhead (1).

Preferably, support member (13) and holding member (7) are rings with ring (13) being seated on ring (7) in use. As can be seen in FIG. 3, the rings can be provided with complementary tapered ends to assist such seating.

The ballast tube (10) may be filled with a volume of a high-density material (19), for example haematite, so as to obtain the required weight for embedding the assembly formed by the wellhead (1) and by the ballast part (9) in the sea floor. Any heavy material may be used for this purpose and haematite has been found to be heavy and cheap.

A sacrificial cable (15) has in this embodiment its two ends connected to connection rings (20) located in the upper vertical plates (6). A plate (17),which is preferably triangular, has a first vertex (17A) connected to a first linking element (25A) inside which passes the sacrificial cable (15). A second vertex (17B) of the plate (17) is connected to one end of a launching and recovery line (16), by means of a second linking element (25B).

In this way, the entire assembly formed by the wellhead (1) and by the ballast part (9) may be supported by recovery line (16) since the ballast part (9) sits on top of the wellhead (1) which itself is supported by the sacrificial cable (15), the triangular plate (17) and by the launching and recovery line (16).

A third vertex (17C) of the plate (17) is linked to one end of a linking line (18) by means of a third linking element (25C). The other end of the linking line (18) is connected to the connection member (12). As will be seen below, the linking line (18) will be used only after the wellhead (1) has been fixed on the sea floor.

Figure 4:
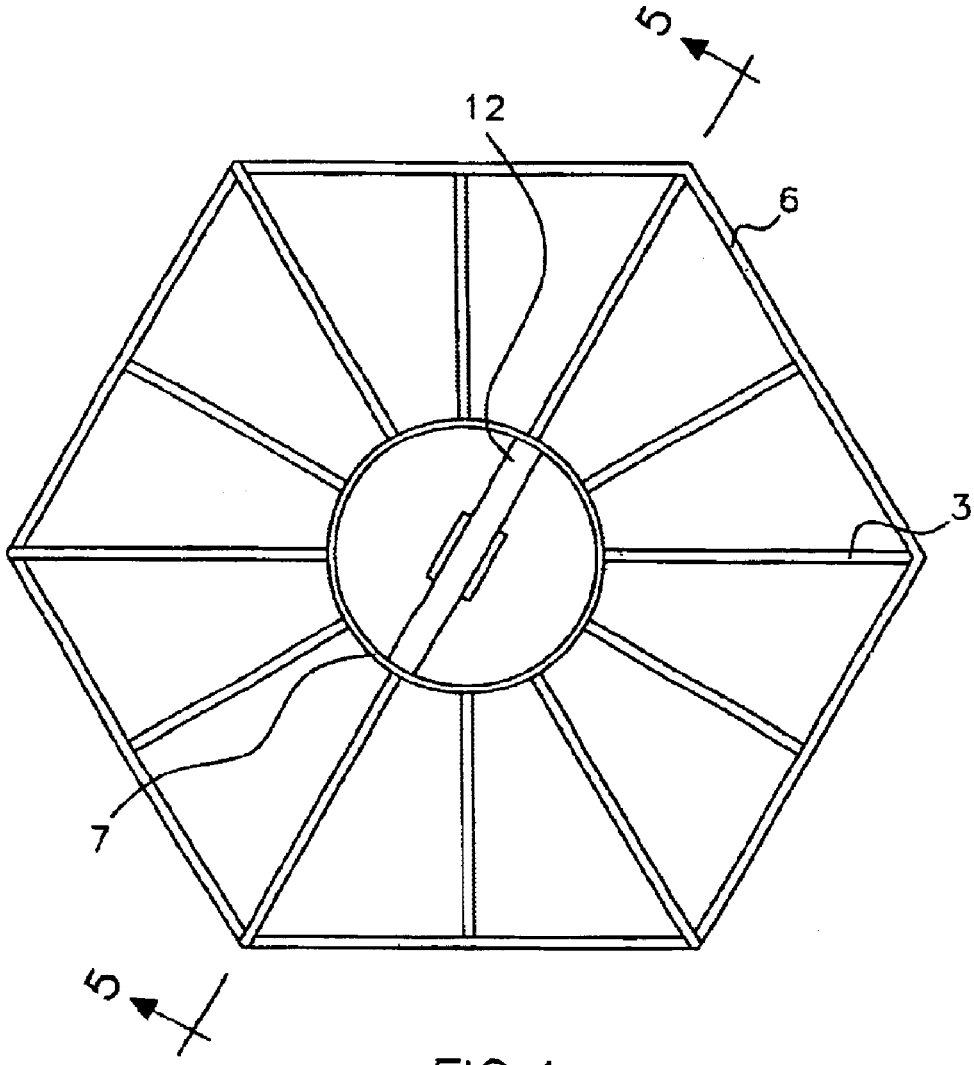
FIG. 4 is a top view of a second embodiment of the apparatus for free-fall installation of an underwater wellhead that is the subject of the present invention.
Figure 5:
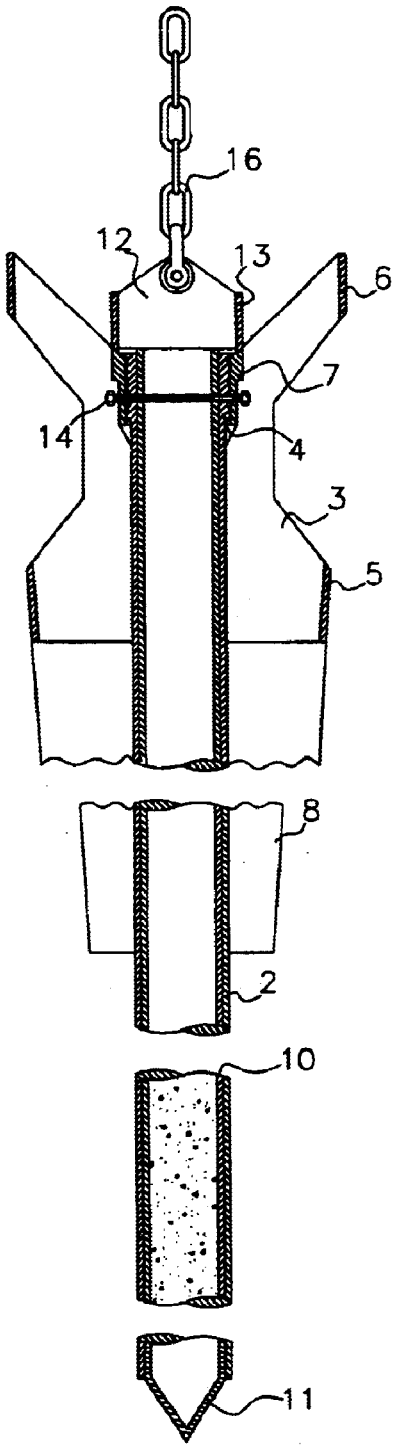
FIG. 5 is a cross-sectional view of the second preferred embodiment of the apparatus, along cross-section line 5—5 in FIG. 4, with certain sections shown missing to assist explanation.
Figure 6:
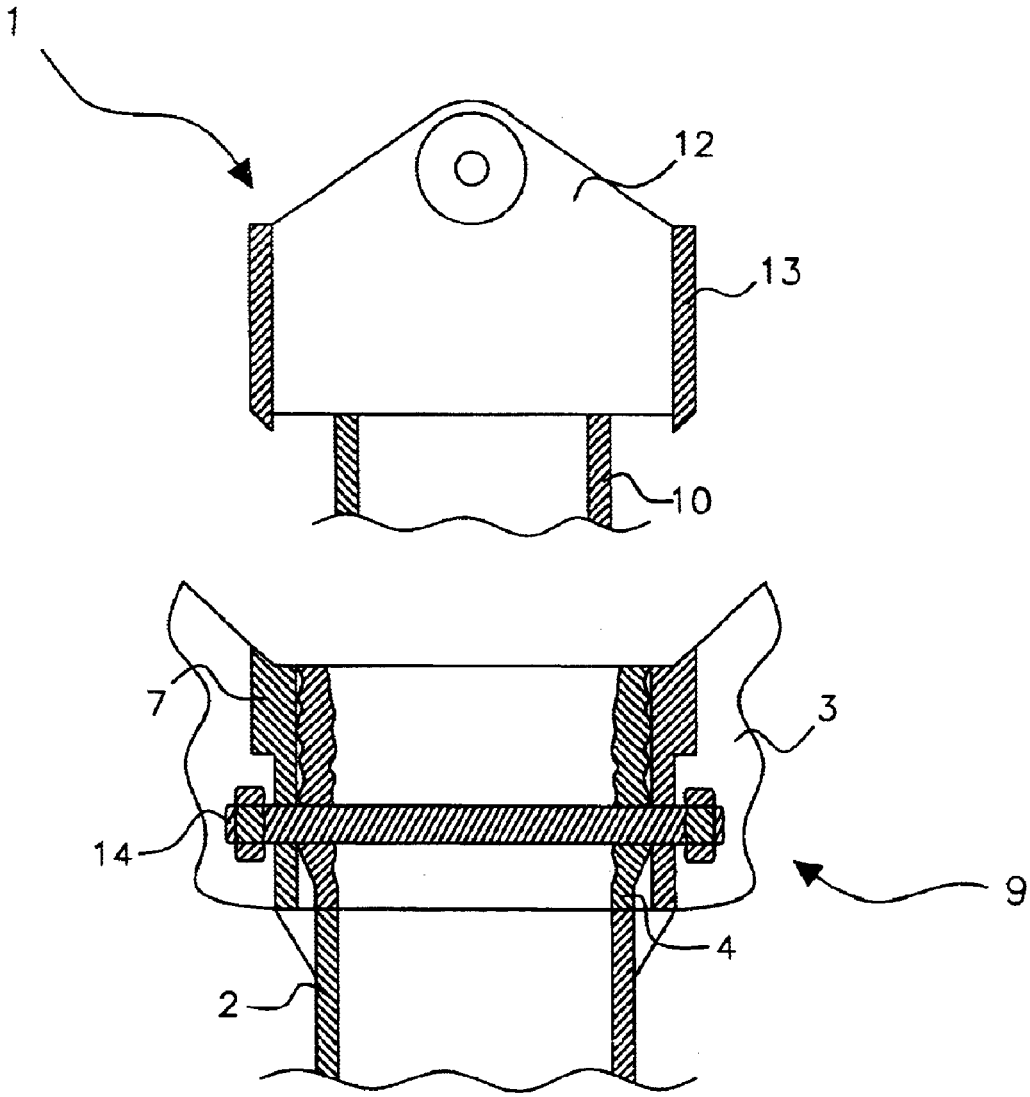
FIG. 6 is a detail of the region of contact between the two principal parts of the second embodiment of the apparatus.

FIGS. 4, 5 and 6 show a second embodiment of the apparatus for free-fall installation of an underwater wellhead. In this embodiment, the components are basically the same as in the preceding embodiment and, for that reason, the same reference numerals are used to indicate common elements, and, to make the description simpler, these will not be described again.

In this second embodiment, the launching and recovery line (16) is connected directly to the connection member (12) of the ballast part (9), and the assembly formed by the wellhead (1) and the ballast tube (9) is, consequently, held directly by the launching and recovery line (16).

In this case, the ballast part (9) has to be rigidly connected to the carrier tube (2) to prevent the latter being able to slide and fall when the assembly formed by the wellhead (1) and the ballast part (9) is suspended from the launching and recovery line (16).

To achieve this, use is made of a releasable fixing pin (14) for fixing the ballast part (9) to the carrier tube (2) of the wellhead (1). It should be pointed out that use may be made of more than one fixing pin (14), or of other fixing means, for achieving this fixing, the use of only one fixing pin (14) having been chosen purely for operational convenience.

A conical tip (11) is in this embodiment fixed to the bottom end of the ballast tube (10) in order to enhance penetration of the wellhead (1) in the seabed. This conical tip (11) may also be used in conjunction with the first embodiment described above.

A description will now be given of the method of using the apparatus for free-fall installation of an underwater wellhead. This method offers advantages on account of its simplicity, since it is based on the concept of the assembly formed by the wellhead (1) and the ballast tube (9) being launched in free fall, utilizing the initial potential energy of the assembly to accelerate the assembly downwardly, so the seabed is impacted with sufficient momentum to cause penetration thereof.

The assembly formed by the wellhead (1) and by the ballast part (9) is initially slowly launched with the aid of a craft with launching equipment, for example a winch. The assembly supported by the launching and recovery line (16) is thus lowered to a predetermined depth in the sea, this stage of the launching operation ending at that point.

Next, the assembly is released so that it can descend in free fall to the seabed. The launching and recovery line (16) remains connected to the assembly so in this context, "released" means that no or minimal tension forces are present in the launching and recovery line which might slow down the assembly in its fall. During free fall, the guide fins (3) and the ballast part (9) allow the centre of gravity of the assembly to be located in its lower part, thus guaranteeing that the assembly holds its course of travel during the fall and until it is embedded in the seabed.

The total free-fall height that the assembly has to travel must be calculated such that the assembly reaches the seabed at a speed that is fast enough for it to be totally embedded in the sea floor to a desired depth. The mass of the assembly and its shape, as well as the material of the seabed may all be taken into account in this calculation.

After the assembly has satisfactorily been embedded in the seabed, the sacrificial cable (15) is cut in the case of the first embodiment, or the pin (14) is removed in the case of the second embodiment, it being possible for divers or a remote operating vehicle to be used to carry out these tasks. Next, the ballast part (9) is raised by means of the launching and recovery line (16).

Before the sacrificial cable (15) is cut, in the case of the first embodiment, or before the pin (14) is removed, in the case of the second embodiment, a check has to be made to ascertain whether the assembly formed by the wellhead (1) and by the ballast part (9) has been correctly launched. If the launch has not been carried out correctly, the whole assembly may be raised and repositioned for a new launch, use being made for this purpose of the same launching and recovery line (16).

In addition to it being possible for the launch height to be varied, the ballast part (9) may have its weight varied by means of an increase or decrease in the ballast material, so as to adjust the speed at which the assembly formed by the wellhead (1) and by the ballast tube (9) will reach the seabed.

In the embodiments of the present application, "launching" of the apparatus is achieved by simply dropping it, i.e. allowing the apparatus to fall under its own weight. However, according to circumstances, such launching could be powered, e.g. by giving the apparatus an initial "push". This may be useful in shallow waters where there may otherwise not be time for the apparatus to reach the ideal embedding speed.

The embodiments presented here are only some of the possibilities of use of the basic concept of the invention, which makes it possible to install underwater wellheads on the seabed by using the inherent weight as a source of energy for the fixing operation.

Thus, these embodiments, including aspects such as the number and shape of the guide fins (3), method of fixing the wellhead (1) to the ballast tube (9), or the use or non-use of a conical tip (11), may in no way be regarded as limiting the invention, which will be limited only by the scope of the appended claims.

What is claimed is:

1. An apparatus for free-fall installation of an underwater wellhead, comprising:

a wellhead constructed and arranged to be embedded in the seabed following its free-fall, a ballast part directly or indirectly releasably attachable to said wellhead, and a holding and recovery means for holding and recovering the ballast part, wherein said holding and recovery means for holding and recovering the ballast part is additionally operable to recover the wellhead, wherein said holding and recovery means comprises a launching and recovery line attached to the ballast part, and wherein said holding and recovery means further comprises a sacrificial cable having its two ends attached to the wellhead and which passes through a first linking element associated with said launching and recovery line, so that, prior to cutting of said sacrificial cable, both said wellhead and said ballast part are supported and recoverable and, after cutting of said sacrificial cable, only said ballast part may be recovered.

2. The apparatus according to claim 1, further comprising structural fins for increasing the axial and lateral load capacity of the wellhead.

3. The apparatus according to claim 2, wherein said structural fins are fixed to the lower portion of said carrier tube.

4. The apparatus according to claim 3, wherein said ballast part contains a volume of high-density material so that the assembled apparatus has a low center of gravity.

5. The apparatus according to claim 4, wherein a lower end of said ballast part is provided with a generally conical piercing tip.

6. An apparatus for free-fall installation of an underwater wellhead, comprising:

a wellhead constructed and arranged to be embedded in the seabed following its free-fall, a ballast part directly or indirectly releasably attachable to said wellhead, and a holding and recovery means for holding and recovering the ballast part, wherein said holding and recovery means for holding and recovering the ballast part is additionally operable to recover the wellhead, wherein said holding and recovery means comprises a launching and recovery line attached to the ballast part, and wherein said holding and recovery means further comprises a fixing means for releasably fixing the ballast part to the wellhead so that, prior to releasing fixing means, both the wellhead and the ballast part are supported and recoverable and, after releasing the fixing means, only said ballast part may be recovered.

7. The apparatus according to claim 6, wherein said fixing means comprises a fixing pin passing through a carrier tube of said wellhead and a ballast tube of said ballast part.

8. The apparatus according to claim 7, further comprising guide fins for guiding the wellhead as it travels through the sea and into the seabed.

9. The apparatus according to claim 8, further comprising structural fins for increasing the axial and lateral load capacity of the wellhead.

10. The apparatus according to claim 8, wherein said guide fins being fixed to the upper portion of said carrier tube.

11. An apparatus for free-fall installation of an underwater wellhead, comprising:

a wellhead constructed and arranged to be embedded in the seabed following its free-fall, a ballast part directly or indirectly releasably attachable to said wellhead, structural fins for increasing the axial and lateral load capacity of the wellhead, and a holding and recovery means for holding and recovering the ballast part, wherein said wellhead comprises a carrier tube and said ballast part comprises a ballast tube able to be fit inside the carrier tube of said wellhead, wherein said holding and recovery means for holding and recovering the ballast part is additionally operable to recover the wellhead, and wherein said holding and recovery means further comprises a sacrificial cable having its two ends attached to the wellhead and which passes through a first linking element associated with said launching and recovery line, so that, prior to cutting of said sacrificial cable, both said wellhead and said ballast part are supported and recoverable and, after cutting of said sacrificial cable, only said ballast part may be recovered.

12. The apparatus according to claim 11, wherein said holding and recovery means further comprises a fixing means for releasably fixing the ballast part to the wellhead so that, prior to releasing the fixing means, both the wellhead and the ballast part are supported and recoverable and, after releasing the fixing means, only said ballast part may be recovered.

13. The apparatus according to claim 12, wherein said fixing means comprises a fixing pin passing through a carrier tube of said wellhead and a ballast tube of said ballast part.

14. The apparatus according to claim 13, comprising guide fins for guiding the wellhead as it travels through the sea and into the seabed.

15. The apparatus according to claim 14, wherein an upper vertical plate is provided to the upper part of the edge of each guide fin and a lower vertical plate is provided to the lower part of the edge of each guide fin.

16. A method of installing an underwater wellhead in the seabed, said method comprising:

launching an assembly comprising said wellhead and a ballast part towards the seabed so that said assembly falls under its own weight and embeds itself in the seabed, and releasing a fixing means once said assembly is embedded in the seabed and recovering the ballast part of said assembly.

17. The method according to claim 16, wherein said assembly is lowered to a predetermined depth in the sea before it is launched.

18. The method according to claim 17, further comprising: guiding the assembly after launch as it falls using guiding fins attached to said assembly.

19. The method according to claim 18, wherein the step of releasing the fixing means comprises: cutting a sacrificial cable attaching said wellhead to said recovery line.

20. The method according to claim 19, wherein the step of releasing the fixing means comprises: removing a fixing pin connecting the ballast part to the wellhead so that pulling the recovery line raises the ballast part but not the wellhead.

21. The method according to claim 18, further comprising: checking whether the assembly has been correctly embedded in the seabed and, if not, recovering the assembly and launching the assembly again until a desired degree of embedding is obtained.

22. The method according to claim 21, wherein said recovering step is carried out by raising a recovery line attached to said ballast part and also directly or indirectly attached to said wellhead.

* * * * *